United States Patent [19]

Allaire et al.

[11] Patent Number: 4,958,507

[45] Date of Patent: Sep. 25, 1990

[54] PROCESS FOR MAKING SOCKS

[75] Inventors: Jacky Allaire, Vailly; Wasil Kozlowskyj, Saint Andre Les Vergers, both of France

[73] Assignee: Devanlay, Troyes, France

[21] Appl. No.: 273,804

[22] Filed: Nov. 21, 1988

[30] Foreign Application Priority Data

Nov. 19, 1987 [FR] France ..... 87 16027

[51] Int. Cl.[5] ..... D04B 9/56

[52] U.S. Cl. ..... 66/19; 66/172 E; 66/185

[58] Field of Search ..... 66/22, 26, 95, 178 R, 66/182, 186, 187, 173, 185, 19

[56] References Cited

U.S. PATENT DOCUMENTS

| | | | |
|---|---|---|---|
| 2,475,845 | 7/1949 | Lawson | 66/187 |
| 2,747,390 | 5/1956 | Reymes-Cole | 66/173 |
| 2,968,937 | 1/1961 | Margulies | 66/187 |
| 2,977,782 | 4/1961 | Sheek | 66/178 R X |
| 3,510,882 | 5/1970 | White | 66/178 R X |
| 3,796,066 | 3/1974 | Millar | 66/95 |
| 3,796,067 | 3/1974 | East | 66/178 R |
| 3,841,113 | 10/1974 | Lucke et al. | 66/95 |
| 4,011,738 | 3/1977 | Furia | 66/22 X |
| 4,070,874 | 1/1978 | Zouhar et al. | 66/177 |
| 4,341,096 | 7/1982 | Safrit et al. | 66/187 X |
| 4,467,626 | 8/1984 | Coble et al. | 66/196 |
| 4,571,960 | 2/1986 | Hursh et al. | 66/178 R X |
| 4,615,188 | 10/1986 | Hursh et al. | 66/178 R X |

FOREIGN PATENT DOCUMENTS

| | | | |
|---|---|---|---|
| 2007299 | 9/1971 | Fed. Rep. of Germany | 66/95 |
| 2555544 | 6/1976 | Fed. Rep. of Germany . | |
| 1039605 | 8/1966 | United Kingdom | 66/185 |
| 1320047 | 6/1973 | United Kingdom | 66/173 |

*Primary Examiner*—Wm. Carter Reynolds

*Attorney, Agent, or Firm*—Fisher, Christen & Sabol

[57] ABSTRACT

Process for making a sock of the type with two layers. A first course knitted by the needles, and corresponding to the end of the tip of a first layer, is transferred onto the central transfer plate of the machine where it is maintained in standby. Knitting of the first layer is continued, from the tip to the mock-rib edges. Then knitting is continued from the mock-rib edges of the second layer up to the tip, the knitted tubular structure being constantly suspended, by one (circular) end, from the central transfer plate and, by the other circular end, from the needle cylinder in the course of work, thus shaping the two concentric layers engaged in one another. The initial course in standby on the plate is transferred to the needles of the cylinder to effect join of the two layers to form one sole terminal layer.

2 Claims, 5 Drawing Sheets

17
17b
17a
18
18b
18a
19
20
21
22

PROCESS FOR MAKING SOCKS

The present invention relates to a process for automatically making, on a knitting machine, particularly a monocylinder one, a sock of the type with two concentric layers fitted one in the other.

The advantages are known of socks constituted by two substantially concentric tubular structures and constituted by an inner layer and an outer layer, the two layers joining and being connected at the tip of the foot.

The socks of this type present advantages concerning the user's comfort.

In fact, they allow various modalities of production from knitting points or structures adapted and suitably positioned on each of the layers so as to give the user pleasure and a feeling of well-being, particularly appreciable at the level of sensitive members or limbs which the feet are.

These advantages are well known, particularly to sportsmen who have always known the use of two socks fitted one on the other; it is obviously simpler to provide, at manufacture, a pair of socks, each sock comprising a double structure and provided to bring the advantages sought by the user in this type of article.

However, the daily use of socks contributing properties of particular comfort and pleasure will also be precious for persons leading an active life involving walking or persons whose profession involves standing for long periods.

Apart from an obvious particularly efficient heat insulation, the double-layer socks of the type concerned here allow an absorption and evacuation of the humidity exuded naturally; however, in addition, the manufacture of socks on two layers makes it possible to provide structures of comfort particularly in the form of loops thus allowing the foot to rest on a veritable carpet inside the shoe ensuring a feeling of shock-absorption each time the foot contacts the ground and consequently, apart from a pleasure and feeling of "walking on felt", the elimination of a source of fatigue and of discomfort.

The double type socks concerned here are conventionally manufactured on a knitting machine with double cylinder, the sock being knitted successively in one piece from the (open) tip of one layer, up to the rib edges, knitting continuing without discontinuity by the rib edges of the other layer up to the open tip of the second layer, after which the knitting operation is terminated.

A structure is thus obtained constituted, in reality, by two socks symmetrically opposite by their common rib edges.

It is then necessary to proceed manually with an operation of integration and of positioning of the inner sock in the outer sock; this operation carried out by hand involves the operator introducing his/her hand through the open tip of the outer sock and seeking from inside the sock the opposite tip which is then returned to be placed in alignment and in conjunction with the first tip.

After which the two tips being flattened and consequently presenting 4 superposed layers, are connected together by linear seam.

This operation presents serious drawbacks in that it requires for each sock a manual operation for passing from a single colinear tubular structure to a tubular structure with two concentric layers.

Moreover, the finishing operation represented by the connection of the two tips, with the necessary assembling of four layers, also represents an operation not without difficulties and which results in a terminal zone of excess thickness at the level of the tip of the foot, source of annoyance and discomfort for the user.

And these operations are all the longer and expensive in manpower as it is necessary to align the four layers forming the final tip and intended to be connected, in a determined plane, so that the finished sock presents a terminal seam substantially following the transverse line of the toes.

The present invention relates, to improvements which make it possible to produce in a particularly simple and elegant manner a tubular structure intended to form a double-layer sock, and in which the structure with two concentric layers is obtained directly on the machine which ensures connection of the two layers when the operation of knitting of the whole of the structure is terminated.

The invention therefore makes it possible to economize the operation of shaping the sock by integration of the two layers one in the other and it furthermore considerably facilitates the operation of finishing consisting in closing the sock at the tip.

Furthermore, the invention makes it possible to use monocylinder circular knitting machines with the advantages of simple operation of this equipment.

To that end, the invention relates to a process for knitting, on a monocylinder circular knitting machine, a sock of the type with two layers, respectively inner and outer, process in which is successively knitted a first layer from the tip of the foot to the heel then from the heel to the mock-rib edges, then continuously, the second layer, integral and in line with the first, from the mock-rib edge to the heel and from the heel to the tip, and the process is characterized by the following successive operations:

(a) a first course knitted by the needles, and corresponding to the end of the tip of a first layer, is transferred onto the central transfer plate of the machine where it is maintained in standby;

(b) knitting of the first layer is continued, from the tip the mock-rib edges, then knitting is continued from the mock-rib edges of the second layer up to the tip, the knitted tubular structure being constantly suspended, by one (circular) end, from the central transfer plate and, by the other circular end, from the needle cylinder in the course of work, thus shaping the two concentric layers engaged in one another;

(c) the initial course in standby on the plate (corresponding to the tip of a first layer) is transferred to the needles of the cylinder (which have just knitted the tip of the other layer) to effect join of the two layers, consequently lying at the level of the two tips of each layer;

(d) knitting is continued on one layer, then constituting a single cylindrical terminal layer, the single terminal layer extending the two preceding layers, this single terminal layer comprising a number of appropriate courses;

(e) knitting of the double sock is interrupted, which then constitutes a finished blank of which the cylindrical tip formed by the single terminal layer has remained open;

(f) the single terminal cylindrical layer is placed flat (in manner known per se) and the two twin faces of this layer are connected by any appropriate means, such as looping or seam, possibly welding by heat-meltable yarn, in order to close the tip of the sock.

Within the scope of carrying out the invention, an inner layer forming a uniform cylindrical tubular structure from the initial tip (in standby on the plate) up to the mock-rib edges is preferably made, whilst the outer layer comprises at the appropriate level and in manner known per se, a shaping of the heel.

According to another development of the invention, there are inserted, on two diametrically opposite points of the needle cylinder, two supple marking means, such as sections of filler yarn, the two sections being diametrically opposite on the needle cylinder, and on the last courses of the single terminal layer (resulting from the join of the inner and outer layers), the marks constituted by the filler yarns make it possible, during the finishing operation, to dispose the sock with a view to closing the tip, by automatically presenting the single terminal layer, face against face, along an appropriate, determined axis.

The two marks are preferably positioned along a diametral axis perpendicular to the plane of symmetry of the shape of the heel on the outer layer, with the result that the alignment of the single terminal layer between the two points of marks, the single terminal layer being brought face against face, automatically makes a transverse line corresponding substantially to the alignment of the toes.

According to an embodiment representing a variant, the process is characterized by the following successive operations:

(a) a first course knitted by the needles is transferred on the central transfer plate of the machine where it is maintained in standby;

(b) knitting is continued over an appropriate length corresponding to substantially twice the height of the leg, thus forming the two concentric layers at the level of the leg;

(c) the initial course is transferred a first time from the central plate on the needle cylinder to knit a single layer resulting from the join of the two layers which together form the leg of the double sock;

(d) after knitting of said single layer over a determined number of courses, the meshes of said single layer are again transferred on the central transfer plate;

(e) the tubular knitting work is then continued over a length necessary for successively forming the inner layer from the ankle up to the tip and the outer layer from the tip to the ankle;

(f) the course of meshes in standby on the plate are then transferred again on the needle cylinder to join the two layers at a level close to the initial single layer intermediate and corresponding substantially to the level of the ankle;

(g) the open part of the tip is closed by looping or seam.

According to a second variant, the double sock may also be shaped so as to be joined at the level of the ankle (in particular for convenient pulling over the user's leg), by knitting the foot first and then the leg.

For carrying out this variant, the process comprises the following operations:

(a) a first course is knitted which is transferred on the central transfer plate of the machine where it is maintained in standby;

(b) knitting is continued over an appropriate length to form the inner layer substantially from the ankle up to the tip and, continuously, the outer layer from the tip up to the ankle, in particular shaping the heel of the outer layer;

(c) the initial course is transferred a first time from the central plate on the needle cylinder to knit a single layer resulting from the join of the two inner and outer layers respectively;

(d) after knitting of said single layer over a determined number of courses, the meshes of this single layer are transferred again on the central plate;

(e) the tubular knitting work is continued over a length making it possible to form successively the inner layer from the ankle up to the top (rib edges) and, in return, the outer layer, from the mock-rib edge up to the ankle;

(f) the course of meshes in standby on the plate is transferred again on the needle cylinder to join the two layers substantially at the level of the ankle;

(g) and the open part of the tip of the double sock is closed by looping or seam.

Other features and advantages of the invention will follow from the following description given in connection with a preferred embodiment presented by way of example and in the light of the accompanying drawings, in which.

Figure 6A:
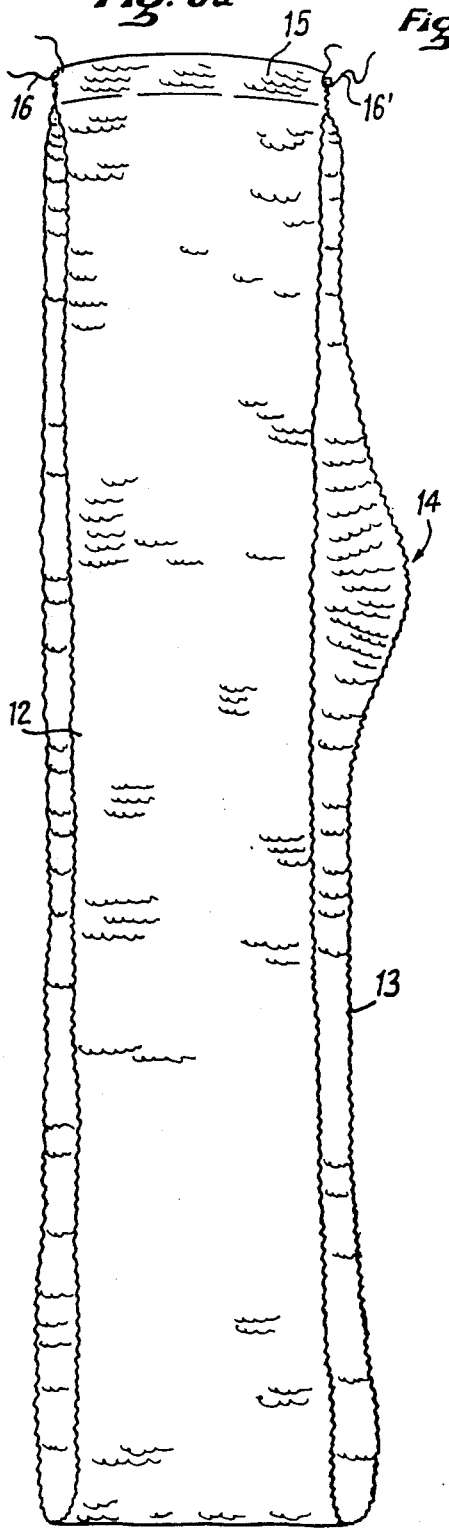
Figure 6B:
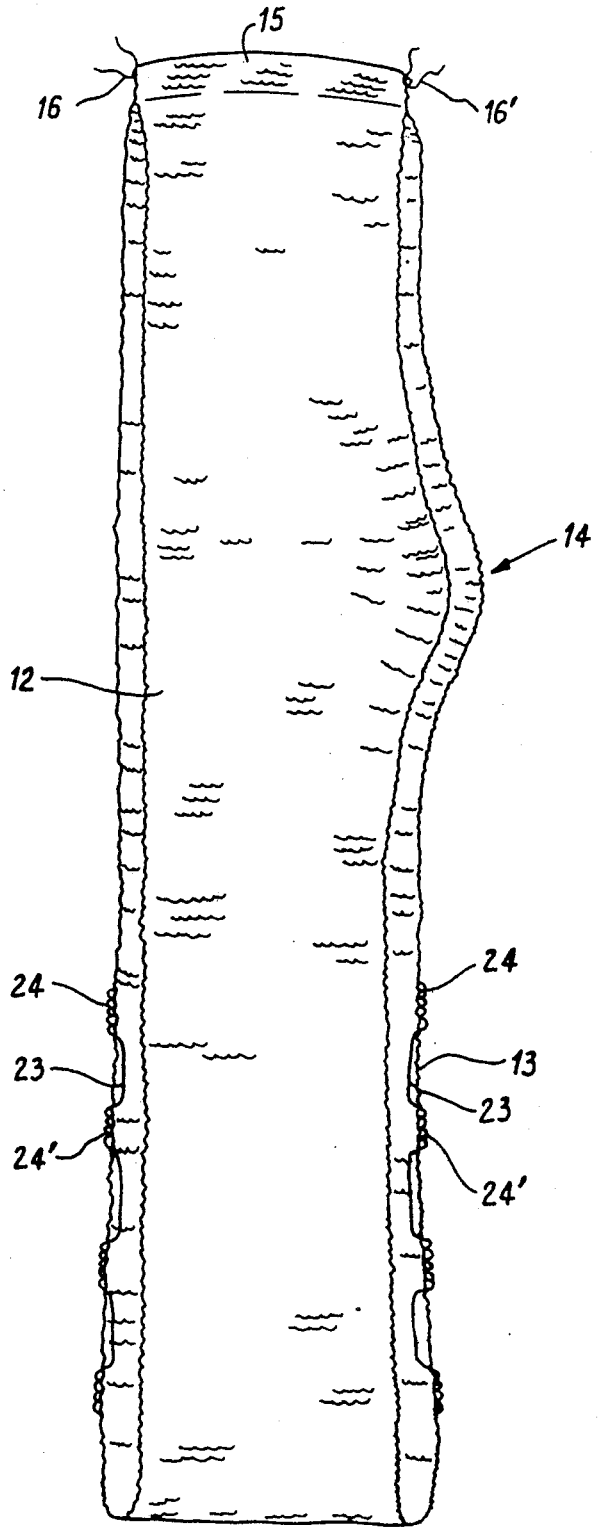

FIG. **6*a* shows the blank of the sock as is delivered by the machine at the end of knitting in a view in transverse section, with tubular inner sock, which, in FIG. 6*b***, comprises a fashioned heel.

Figure 7:
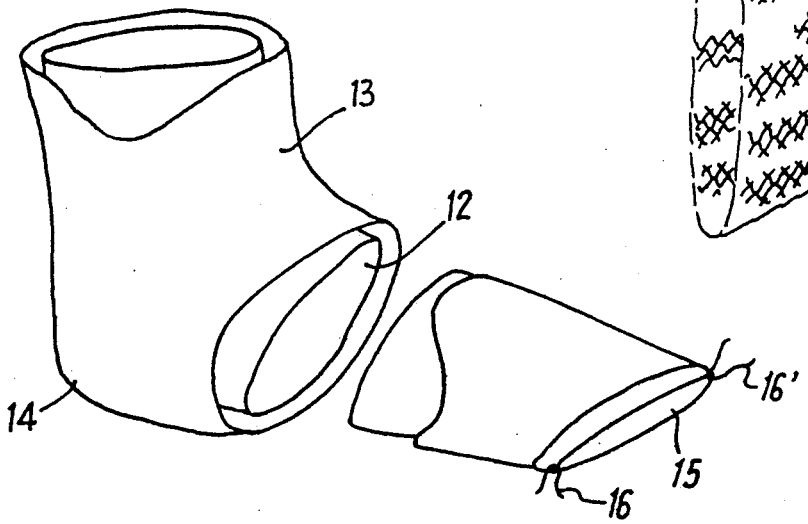

FIG. 7 shows a view with the foot of the sock torn away before the operation of finishing, i.e. of connection of the two faces of the tip.

Figure 8:
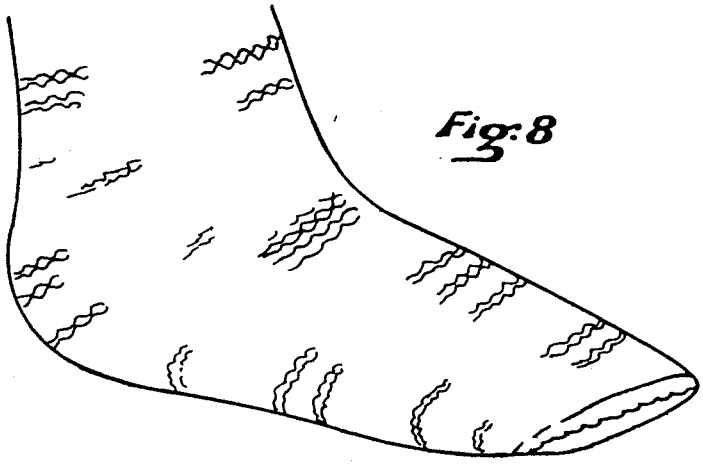

FIG. 8 shows the foot of the sock once finished and after the operation of connection of the two faces of the tip.

Figure 9:
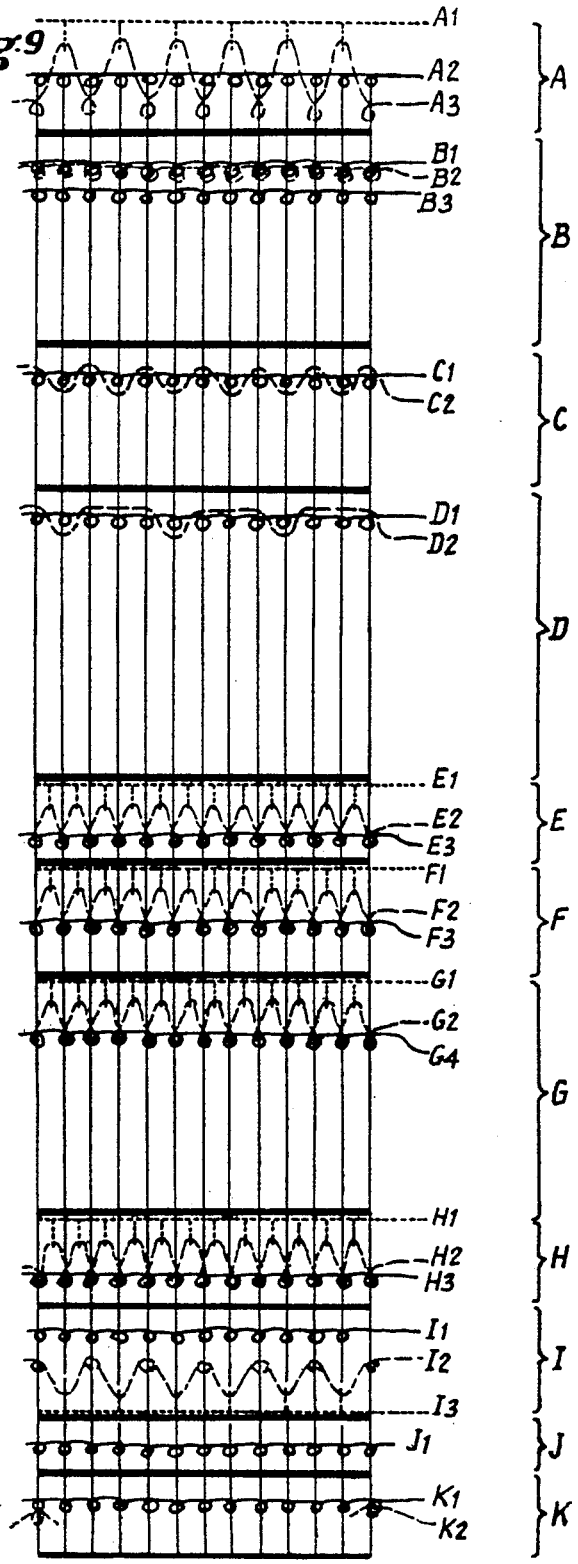

FIG. 9 shows a diagram of the successive work of the needles all along the making of the tubular structure having to shape the blank of the sock.

Within the scope of carrying out the present invention, a monocylinder circular knitting machine of known type is used.

FIGS. 2 to 5 show along broken line 1 the ring of needles of which only needles 2, 3, 4, etc. . . have been shown.

At the center of the ring of needles is schematically shown the transfer plate 5.

It is specified that this plate is shown schematically here and it is separated from the needle ring 1 by a distance in ring form which is considerably magnified to render the drawings clearer, it being understood that in reality the transfer plate 5 comes into position immediately juxtaposed with respect to the needle ring 1, thus allowing the clearances of interferences between the transfer needles (not shown) positioned radially on the plate and the knitting needles 2, 3, 4 belonging to the ring 1.

In manner known per se, as soon as the first course of stitches has been knitted, the needles of plate 5 are actuated to take the first knitted course and conserve this course in standby on the plate, whilst the work of the needles 2, 3, 4 continues, thus knitting a tubular structure, this in conventional manner.

Figure 3:
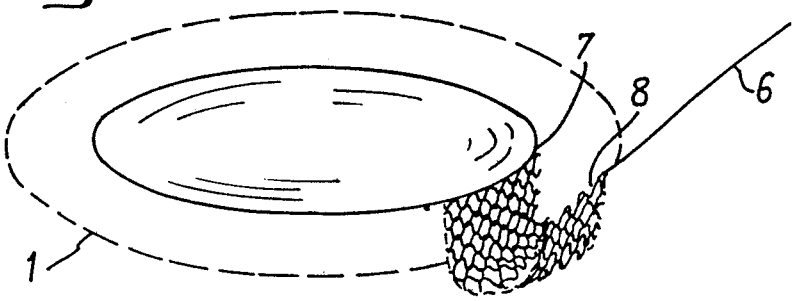
FIGS. 3 and 4 show subsequent phases of the sock in the course of knitting at two successive phases of the production thereof.
Figure 4:
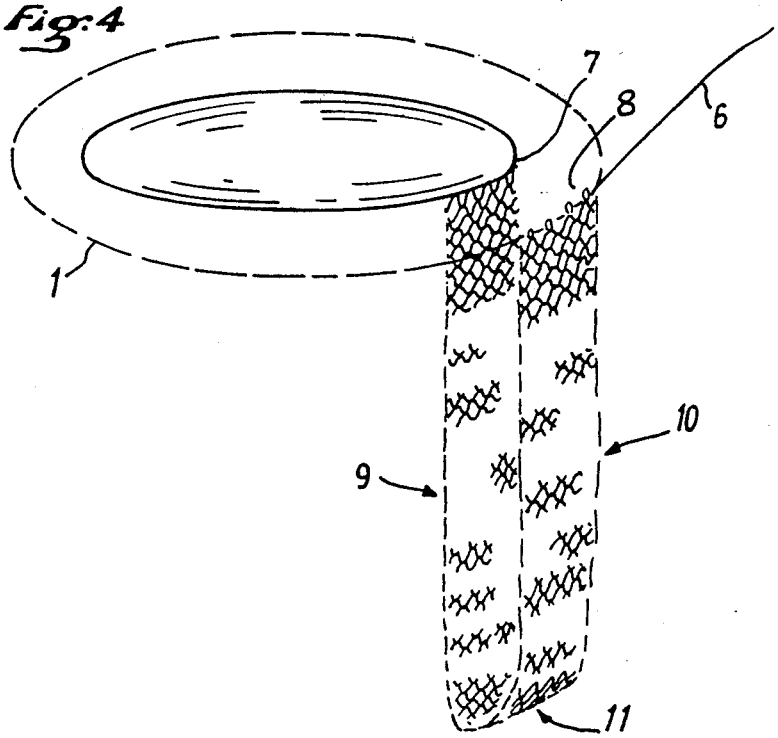

As seen in FIG. 3, then in FIG. 4, as the yarn 6 which supplies the machine is knitted, a tubular structure is knitted of which one circular end 7 is in standby on plate 5 whilst the other end 8 is constituted by the course of stitches being knitted.

And between these two ends, the tubular structure is suspended; and as the two ends, respectively end 7 in standby and end 8 being knitted, are substantially at the same level, and the courses of knitting accumulating, the tubular structure thus shaped is at any moment in concentric position and consequently defining two layers, namely an inner layer 9 and an outer layer 10, joined by the lower angle 11.

The detail of the knitting structures employed will be described hereinafter, it being understood that the knitting structures may vary and are not characteristic of the embodiment of the invention, the data specified hereinafter corresponding only to one modality and to a particular embodiment.

However, and as seen more clearly in FIG. *6a/6b*, the machine preferably firstly knits a uniform tubular structure of constant section 12, which will constitute the inner sock; having arrived at an appropriate spot corresponding to the level of the heel 14, the knitting machine makes a protuberance (in Y form), in known manner, which will shape the heel on the outer sock 13.

Figure 5:
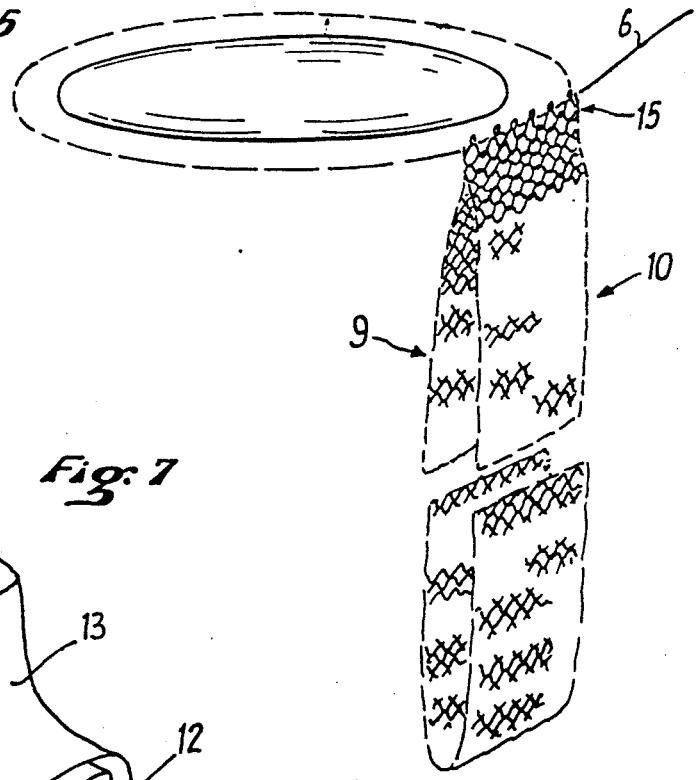
FIG. 5 shows the terminal phase of production of the sock in which the two layers are joined by transfer of the course of stitches in standby from the transfer plate on the set of circular needles.

And according to FIGS. 5 and *6a/6b*, it is seen that, when the sock has been knitted over the whole length corresponding to the blank having to emerge from the machine, the initial course of stitches which was in standby on the transfer plate is transferred on the knitting needles belonging to cylinder 1.

This operation is effected in conventional manner, the needles of the plate which support the meshes are taken by a movement of horizontal and radial slide, to the level of the knitting needles, which are inserted in the eye of the transfer needles and may thus take over each of the stitches positioned in standby on the transfer plate.

At that level, the standby stitches which consequently constitute the terminal edge 7, become integral with the terminal edge 8 being knitted and these two courses of stitches are then joined and assembled, the subsequent work of the machine producing a series of courses of stitches defining a single terminal layer 15 resulting from the join of the two layers 9 and 10 respectively.

This single terminal layer 15 extends over several courses so as to allow subsequent connection and closure of the tip.

Particularly with reference to FIG. 6 which shows the blank (seen in section) such as emerging from the machine, which is obtained by employing the mechanical means existing on the monocylinder knitting machine, there is thus seen a complex assembly in which the two layers, respectively inner 12 and outer 13, are fitted in each other on the one hand, this automatically and without manual intervention, whilst on the other hand these two layers are, at their upper ends corresponding to the tip of the foot, joined to form one terminal layer 15.

As has been set forth, this presents the double advantage: on the one hand, of avoiding the manual operation of assembly and engagement of the two layers in each other; and, on the other hand, of offering, at the level of the tip which must be closed, not four thicknesses intended to be assembled, but a single cylindrical layer 15 which, placed flat and face against face, will consequently represent the assembly of two thicknesses only.

In addition, according to a particular feature of the invention, two sections of filler yarns 16, 16' are automatically brought during knitting of the last course of the single terminal layer 15.

These yarns are preferably of such a colour as to be easily seen and they effectively each constitute a mark which will allow alignment and correct positioning of the single terminal layer 15 during the final fashioning operation for closing the tip.

These two marking yarns 16 and 16' are easily positioned on the machine, during knitting of the terminal courses of the single layer 15, the filler yarns 16 and 16' being positioned in diametrically opposite manner, perpendicularly to the plane of symmetry of tailoring of the heel.

In this way, by placing flat the single terminal layer 15 between the two marking yarns 16 and 16', the closure of the tip may be positioned along a horizontal line which will correspond substantially to the alignment of the end of the toes, thus enabling the sock to follow the morphology of the foot.

According to a variant which has not been shown, the programmation of the knitting work may be provided (on the control cylinder or by computerized programming means) so as to cause decreases at the level of the tip and of the join of the two inner (12) and outer (13) layers; it will be understood that, in that case, the work of the machine will start from a narrower tubular structure and will increase rapidly to attain the tubular structure 12 corresponding to the inner sock and, at the end of knitting, the reverse operation will be provoked, i.e. a reduction causing decrease of diameter to resume the initial diameter, the two ends of the blank at the end of knitting then joining along an identical diameter to shape the terminal layer 15.

Figure 1:
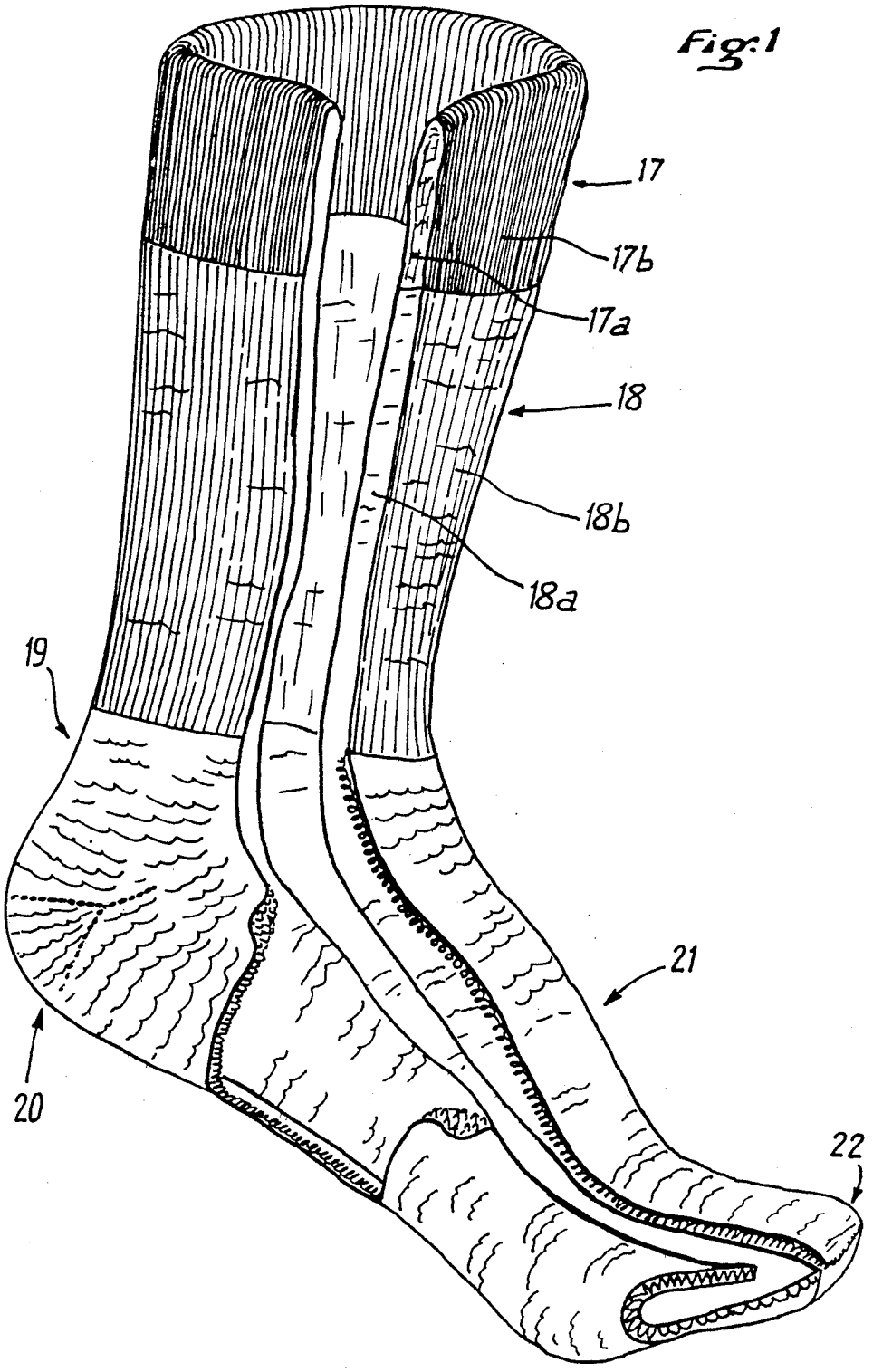
FIG. 1 shows a view with parts torn away of the finished sock made according to the process of the invention.
Figure 2:
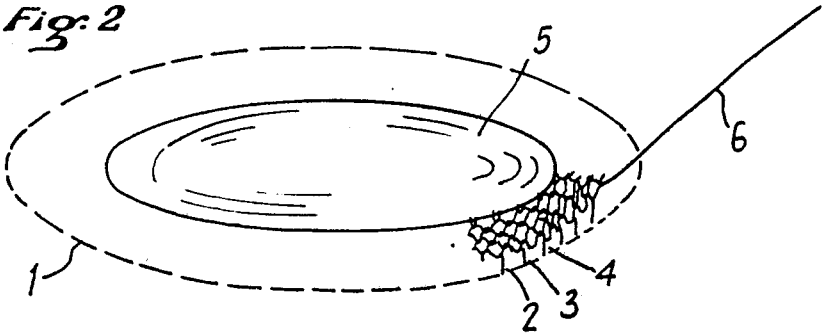
FIG. 2 shows a schematic view showing the positioning of the first courses of stitches on the central transfer plate.

FIG. 1, on the one hand, and the knitting diagram 9 on the other hand, gives a detail of carrying out the invention in a particular embodiment presented by way of illustrative example.

On the sock shown in FIG. 1, 17 represents the double welt knitted independently, knitted (on monocylinder) in a jersey structure with gum laying in on a basis of selection 1 and 1, giving a 1×1 mock-rib appearance (type of selection allowing different sorts of mock-rib).

17*a* designates the inner layer in 1=1 mock-rib identical to the outer layer 17*b*; however, it may be provided that the inner layer 17*a* be made on a jersey basis like the whole of the inner sock of tubular structure of constant section (cf. FIG. 6).

18 designates the leg, the inner layer 18*a* is made in a jersey structure on plaited cotton yarn, one course out of two on lycra gum yarn; alternately, the jersey stitch may be made in a plaited structure on all the courses.

19 designates the top of the heel in which appear the loops provided on the inner face of the outer layer.

The heel 20 has here been fashioned in Y form in order to ensure a better comfort still in a so-called sandwich loop structure in plaited cotton, polyamide or lycra; however, the heel may be made in simplified form or in pocket form.

The foot 21 is knitted in the same sandwich loop structure in plaited cotton, polyamide or lycra; the foot may be knitted entirely in loop form; it may also comprise loops on the sole only, the top being made in jersey.

The tip 22 may be fashioned, decreased or straight, still in plaited cotton, polyamide or lycra with loops up to the end tip.

Assembly of the two layers is obtained as described hereinabove by transfer of stitches directly on the knitting machine; the embroidery yarns 16, 16' ensure correct centering for looping.

It will be understood that the order of the comments which has been retained here for FIG. 1 does not correspond to the order of the knitting operations, since (as clearly set forth hereinbefore), the knitting starts from the tip of the inner layer up to the rib edge and then returns continuously from the rib edges up to the tip of the outer layer.

This is moreover clearly illustrated in FIG. 9 which gives a diagram of knitting structure in which the references indicated correspond to the operations specified hereinafter and using the yarns thus defined:

cotton/acrylic 75/25- 4/70 nm
covered elastothane polyamide (1) - 95 dtex
covered elastothane polyamide (2) - 1/10.3 nm
polyamide - 2/78 dtex 20 strands (A) Knitting of the beginning of the sock with transfer of the stitch on the transfer plate.
A1—Transfer plates
A2—Polyamide 1 end
A3—Polyamide 2 ends (B) Inner sock, jersey cotton or plaited silk, lycra or polyamide.
B1—Covered elastothane (1) 1 end
B2—Cotton/acrylic 1 end
B3—Cotton/acrylic 1 end (C) Double welt, mock-rib 1×1 appearance
C1—Cotton/acrylic 2 ends
C2—Covered elastothane (2) 1 end (D) Leg, 3×1 mock-rib
D1—Cotton/acrylic 2 ends
D2—Covered elastothane (2) 1 end (E) Top of heel, so-called sandwich loop
E1—Loop decreasing plates
E2—Cotton/acrylic 1 end
E3—Polyamide 2 ends (F) Heel, so-called sandwich loop
F1—Loop decreasing plates
F2—Cotton/acrylic 2 ends
F3—Polyamide 2 ends (G) Foot, all loop, so-called sandwich
G1—Loop decreasing plates
G2—Cotton/acrylic 2 ends
G3—Polyamide 2 ends (H) Decreased or straight tip, so-called sandwich loop
H1—Loop decreasing plates
H2—Cotton/acrylic 2 ends
H3—Polyamide 2 ends (I) Transfer of stitches from the inner sock on the outer socks
I1—Polyamide 2 ends
I2—Polyamide 2 ends
I3—Transfer plate (J) Position of looping
J1—Polyamide 1 end (K) Underlap with marking by embroidery yarn for centering the tip
K1—Cotton/acrylic 3 ends+Polyamide 2 ends
K2—Embroidery yarn cotton/acrylic 2 ends In addition, the invention makes it possible to produce socks with high decorative power; in fact, the yarns for effect or decorative yarns added in the course of knitting, in the case of a simple conventional sock, project and float on the inner face of the sock where they constitute a risk of catching, for example for the toes when the sock is being pulled on, apart from the unsightly appearance of these float yarns. In the case of the sock according to the invention, the yarns for effect added in the course of knitting on the outer layer may be allowed to project on the rear face since this face is lined by the layer constituting the inner sock; the decorative yarns therefore remain hidden in the interface between the two layers, respecting the fine presentation of the whole and the smooth wall encountered by the foot when the sock is being pulled on. FIG. **6*b* shows these float yarns 23 between two courses 24, 24' forming decorative stripes; the float yarns are imprisoned between the layers 13 and 12** and cannot aggress the foot when the sock is being pulled on, nor are they visible on the sock even turned inside out.

The invention also makes it possible to produce orthopedic socks comprising an inner layer forming envelope for holding or retention, associated with an outer layer of normal appearance, decorated or not, thus avoiding the sometimes unsightly appearance of treatment or medical socks. The inner sock or layer may in fact be knitted with appropriate characteristics to ensure the desired effect of holding.

We claim:

1. A process for making a sock having two layers on a monocylinder circular knitting machine having a central transfer plate, a needle cylinder disposed outside of and around said transfer plate, said needle cylinder comprising a plurality of knitting needles, said process comprising the following successive steps:

(a) knitting a first course of yarn corresponding to the end of the first layer of said sock;

(b) transferring said first course of yarn to said central transfer plate where said first course of yarn is maintained in standby;

(c) using said knitting needles to knit additional courses of yarn while said first course continues to be maintained in standby by said central transfer plate, said additional courses representing, successively, the foot, heel and top portions of the inner layer of said sock and thereafter, the top, heel and foot portions of the outer layer of said sock, whereby during said knitting, said additional courses of yarn will hang down from said central transfer plate and said needle cylinder;

(d) transferring said first course of yarn to said plurality of knitting needles and using said knitting needles to joint together said inner and outer layers, whereby the space between said inner and outer layers of said sock is closed off at a point corresponding to the tip of said sock;

(e) using said plurality of needles to knit additional courses of yarn, said additional courses of yarn providing a single cylindrical terminal layer extending said inner and outer layers, said terminal layer corresponding to the tip of said sock; and (f) removing said piece of cylindrical knitted material from said monocylinder circular knitting machine and connecting together said terminal layer whereby the tip of said sock is closed.

2. A process for making a sock having two layers on a monocylinder circular knitting machine having a central transfer plate, a needle cylinder disposed outside of and around said transfer plate, said needle cylinder comprising a plurality of knitting needles, said process comprising the following successive steps:

(a) knitting a first course of yarn corresponding to the end of the first layer of said sock;

(b) transferring said first course of yarn to said central transfer plate where said first course of yarn is maintained in standby;

(c) using said knitting needles to knit additional courses of yarn while said first course continues to be maintained in standby by said central transfer plate, said additional courses representing, successively, the foot, heel and top portions of the inner layer of said sock and thereafter, the top, heel and foot portions of the outer layer of said sock.

wherein said plurality of knitting needles are used to form said inner layer having a uniform cylindrical tubular structure, but wherein said plurality of knitting needles are used to modify the pattern of said outer layer to include excess material in the area corresponding to the heel portion of said sock, whereby during said knitting, said additional courses of yarn will hang down from said central transfer plate and said needle cylinder;

(d) transferring said first course of yarn to said plurality of knitting needles and using said knitting needles to join together said inner and outer layers, whereby the space between said inner and outer layers of said sock is closed off at a point corresponding to the tip of said sock;

(e) using said plurality of needles to knit additional courses of yarn, said additional courses of yarn providing a single cylindrical terminal layer extending said inner and outer layers, said terminal layer corresponding to the tip of said sock; and (f) removing said piece of cylindrical knitted material from said monocylinder circular knitting machine and connecting together said terminal layer whereby the tip of said sock is closed.

* * * * *